US009376930B2

(12) United States Patent
Kim et al.

(10) Patent No.: US 9,376,930 B2
(45) Date of Patent: Jun. 28, 2016

(54) WASTE GATE VALVE

(71) Applicants: Hyundai Motor Company, Seoul (KR); HYUNDAI WIA CORPORATION, Changwon-si (KR)

(72) Inventors: Kwang Hwan Kim, Suwon-si (KR); Seung Yeon Lee, Seoul (KR); Dong Ho Chu, Ansan-si (KR); Ui Yeon Park, Pyeongtaek-si (KR); Kyung-Wook Jin, Incheon (KR); Sung-Jin Yang, Suwon-si (KR); Jun Gwan Park, Suwon-si (KR); Gil-Beom Lee, Seoul (KR); Kyung-Jae Jung, Suwon-si (KR)

(73) Assignees: Hyundai Motor Company, Seoul (KR); HYUNDAI WIA CORPORATION, Changwon-si (KR)

( * ) Notice: Subject to any disclaimer, the term of this patent is extended or adjusted under 35 U.S.C. 154(b) by 15 days.

(21) Appl. No.: 14/473,076

(22) Filed: Aug. 29, 2014

(65) Prior Publication Data

US 2015/0115192 A1 Apr. 30, 2015

(30) Foreign Application Priority Data

Oct. 30, 2013 (KR) ..... 10-2013-0129964

(51) Int. Cl.
*F01D 17/10* (2006.01)

(52) U.S. Cl.
CPC ..... *F01D 17/105* (2013.01); *F05D 2220/40* (2013.01); *F05D 2230/237* (2013.01); *F05D 2230/31* (2013.01); *F05D 2260/941* (2013.01); *F05D 2300/177* (2013.01); *F05D 2300/20* (2013.01); *Y10T 137/7036* (2015.04)

(58) Field of Classification Search
CPC ..... F01D 17/105; F05D 2230/31; F05D 2220/40; F05D 2300/177; F05D 2300/20; F05D 2260/941; F05D 2230/237; Y10T 137/7036
USPC ..... 137/375; 251/298–303, 359, 368; 60/602
See application file for complete search history.

(56) References Cited

U.S. PATENT DOCUMENTS 2,274,776 A * 3/1942 Cull ..... F16K 1/2028 251/298
2,717,001 A * 9/1955 Perrault ..... F16K 25/02 251/360
3,720,229 A * 3/1973 Masson ..... G01F 7/00 137/527.8
4,079,747 A * 3/1978 Roberts ..... F16K 1/22 137/375
4,463,564 A * 8/1984 McInerney ..... F01D 17/105 137/892
4,469,122 A * 9/1984 Meek ..... F16K 15/03 137/312
4,730,456 A * 3/1988 Tadokoro ..... F01D 17/18 251/298
4,904,542 A * 2/1990 Mroczkowski ..... C23C 14/0652 416/241 B
5,135,808 A * 8/1992 Kimock ..... B32B 17/06 428/336

(Continued)

FOREIGN PATENT DOCUMENTS

JP 4-117150 U 10/1992
JP 7-10434 U 2/1995

(Continued)

*Primary Examiner* — John Bastianelli
(74) *Attorney, Agent, or Firm* — Morgan, Lewis & Bockius LLP

(57) ABSTRACT

A waste gate valve which is installed on a turbocharger to selectively discharge a part of exhaust gas while allowing the part of the exhaust gas to bypass the turbocharger, may include a layer which is formed between a valve seat and a valve body that comes into contact with the valve seat.

5 Claims, 3 Drawing Sheets

(56) References Cited

U.S. PATENT DOCUMENTS 5,161,728 A * 11/1992 Li ..... B22F 1/025 228/124.1
5,205,125 A * 4/1993 Potter ..... F02B 37/186 137/527
5,205,532 A * 4/1993 Naehring ..... F16K 51/02 251/298
5,205,533 A * 4/1993 Berchem ..... F16K 5/0605 137/375
5,309,874 A * 5/1994 Willermet ..... F01L 1/143 123/90.51
5,934,321 A * 8/1999 Miya ..... F16K 11/0743 137/625.41
6,267,307 B1 * 7/2001 Pontoppidan ..... F02M 61/06 239/104
6,502,416 B2 * 1/2003 Kawasumi ..... F25C 1/045 62/347
6,976,359 B2 * 12/2005 Hastings ..... F02B 37/183 251/298
7,360,362 B2 * 4/2008 Nicolle ..... F01N 13/10 60/612
7,552,911 B2 * 6/2009 Stark ..... F01L 3/02 123/188.3
7,562,647 B2 * 7/2009 Burton ..... F01L 3/04 123/188.3
8,261,771 B2 * 9/2012 Witkowski ..... F16K 15/03 137/527.2
2007/0068496 A1 * 3/2007 Wright ..... F02M 21/0239 123/527
2007/0163655 A1 * 7/2007 Hunter ..... F16K 3/02 137/375
2010/0187460 A1 * 7/2010 An ..... F02B 37/013 251/301
2011/0005222 A1 * 1/2011 Hayashi ..... F02B 37/183 60/602
2012/0210709 A1 * 8/2012 Cizek ..... F01D 17/105 60/602
2012/0312010 A1 * 12/2012 Yasoshima ..... F01D 17/105 60/602
2013/0199175 A1 * 8/2013 Hoshi ..... F01D 17/105 60/602

FOREIGN PATENT DOCUMENTS

JP 2003-207059 A 7/2003
KR 2000-0042147 A 7/2000
KR 10-0420243 B1 3/2004

* cited by examiner

WASTE GATE VALVE

CROSS-REFERENCE TO RELATED APPLICATION

The present application claims priority to Korean Patent Application No. 10-2013-0129964 filed Oct. 30, 2013, the entire contents of which are incorporated herein for all purposes by this reference.

BACKGROUND OF THE INVENTION

1. Field of the Invention

The present invention relates to a waste gate valve, and more particularly, to a waste gate valve that is installed on a turbocharger for increasing output of an engine, and adjusts an amount of exhaust gas.

2. Description of Related Art

In general, a turbocharger is a device that increases output of an engine by rotating a turbine using pressure of exhaust gas discharged from the engine, and by supercharging high-pressure air in a combustion chamber using rotational force of the turbine.

The turbocharger includes a turbine and a compressor which are coaxially connected, and a waste gate valve which controls an amount of exhaust gas by an operation of an actuator.

The waste gate valve is a device that is installed on the turbocharger to discharge a part of the exhaust gas, which flows toward the turbocharger, while allowing the part of the exhaust gas to bypass the turbocharger, or to adjust boost pressure applied to an intake manifold.

The waste gate valve is exposed to high-temperature exhaust gas, and particularly, a portion thereof, which comes into contact with a valve seat, may be thermally deformed and abraded due to high-temperature exhaust gas.

The deformation and abrasion due to high-temperature exhaust gas result in deterioration in overall performance of the turbocharger, and a loss of function of the waste gate valve.

The information disclosed in this Background of the Invention section is only for enhancement of understanding of the general background of the invention and should not be taken as an acknowledgement or any form of suggestion that this information forms the related art already known to a person skilled in the art.

BRIEF SUMMARY

Various aspects of the present invention are directed providing a waste gate valve which uses a ceramic layer to have high durability and withstand deformation and abrasion caused by high-temperature exhaust gas.

In an aspect of the present invention a waste gate valve which is installed on a turbocharger to selectively discharge a part of the exhaust gas while allowing the part of the exhaust gas to bypass the turbocharger may include a layer which is formed between a valve seat and a valve body that comes into contact with the valve seat.

The layer may be formed on only one surface of the valve body which faces the valve seat of the waste gate.

The layer may include a ceramic layer which comes into contact with the valve seat; and an insert material which is interposed between the valve body and the ceramic layer.

The insert material may be made of a material that has a lower melting point than the valve body.

The insert material may include nickel (Ni), chromium (Cr), boron (B), silicon (Si), and iron (Fe).

The layer may be formed by joining the ceramic layer to the valve body using the insert material by brazing.

The joining may be performed as brazing.

The brazing may be performed in a high-temperature vacuum state.

The brazing may be performed in a high-temperature vacuum furnace, and a temperature in the vacuum furnace may be lower than a melting point of the valve body, and higher than a melting point of the insert material.

According to the exemplary embodiment of the present invention, the ceramic layer is formed on a surface that comes into contact with the valve seat, such that deformation and abrasion due to a high temperature may be prevented in comparison with the waste gate valve of the related art which is manufactured only by using metal, thereby preventing deterioration in performance of the turbocharger and deterioration in function of the waste gate valve.

In addition, in the exemplary embodiment of the present invention, when the ceramic layer is formed, the insert material, which has a lower melting point than a material of the valve body, is interposed between the valve body and the ceramic layer, thereby ensuring joinability between the valve body and the ceramic layer.

In addition, in the exemplary embodiment of the present invention, when an opening and closing operation is performed, operational noise, which is generated between the valve body and the valve seat, may be reduced by the ceramic layer and the insert material.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
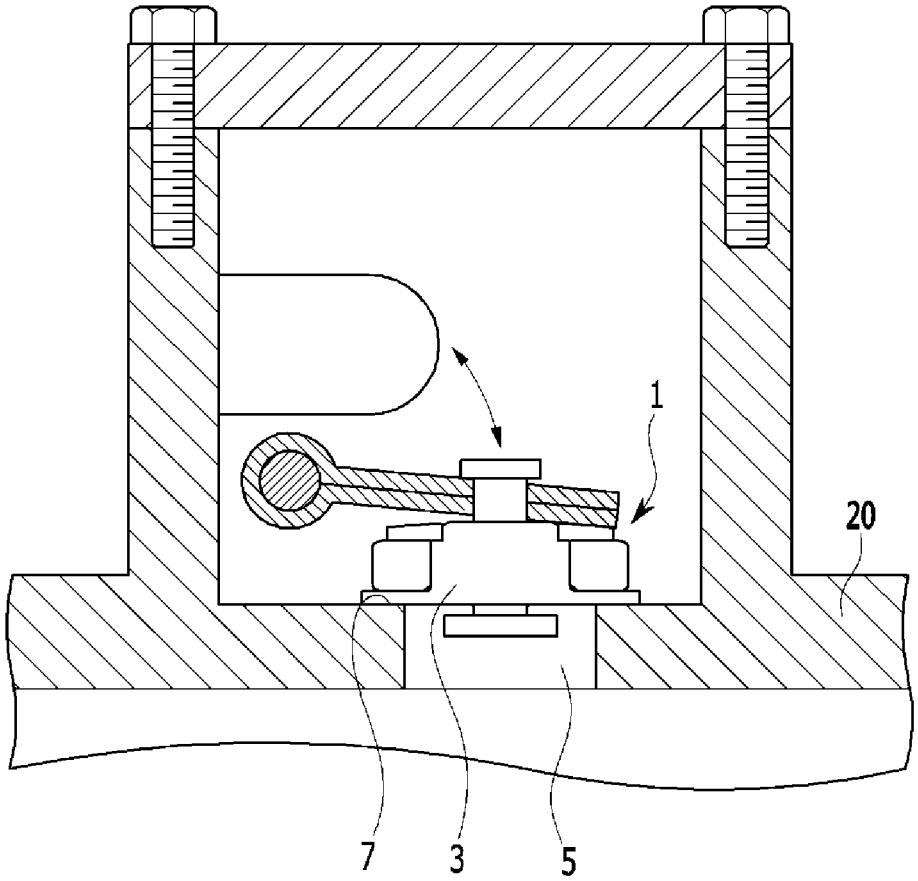
FIG. 1 is a view illustrating a waste gate valve according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described in detail with reference to the accompanying drawings.

The size and thickness of each component illustrated in the drawings are arbitrarily shown for understanding and ease of description, but the present invention is not limited thereto. Thicknesses of several portions and regions are enlarged for clear expressions.

In addition, a part irrelevant to the description will be omitted to clearly describe the exemplary embodiments of the present invention.

In an aspect of the present invention, a waste gate valve 1 according to the exemplary embodiment is a device that is installed on a turbocharger to discharge a part of exhaust gas while allowing the part of the exhaust gas to bypass the turbocharger when pressure of exhaust gas reaches a predetermined level or more.

Here, because an actuator, which operates the turbocharger and the waste gate valve 1, is a configuration of a publicly known technology which is widely known in the corresponding industrial field, a detailed description thereof will be omitted.

Figure 2:
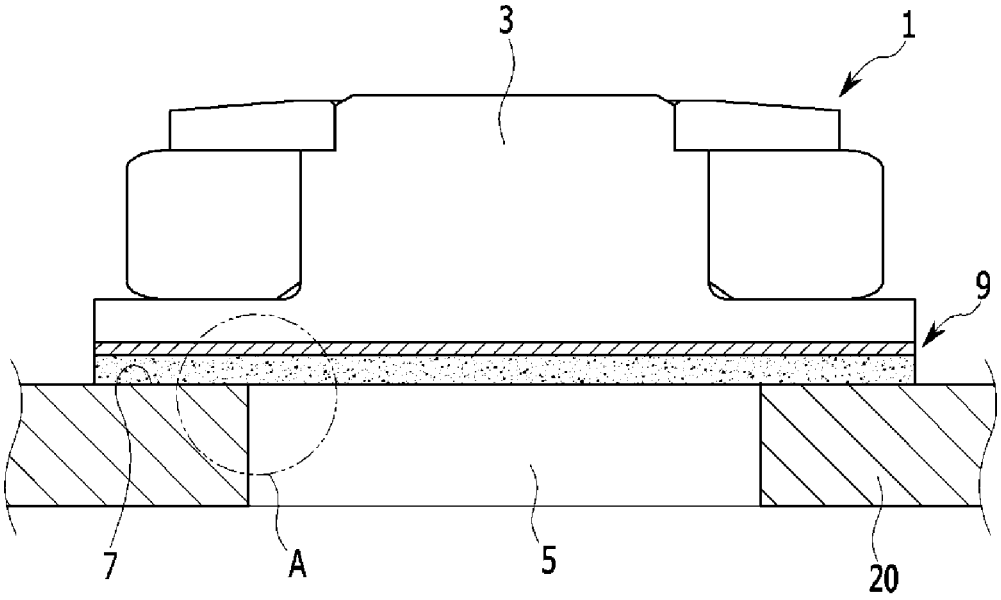
FIG. 2 is a partial enlarged view of the waste gate valve according to an exemplary embodiment of the present invention.
Figure 3:
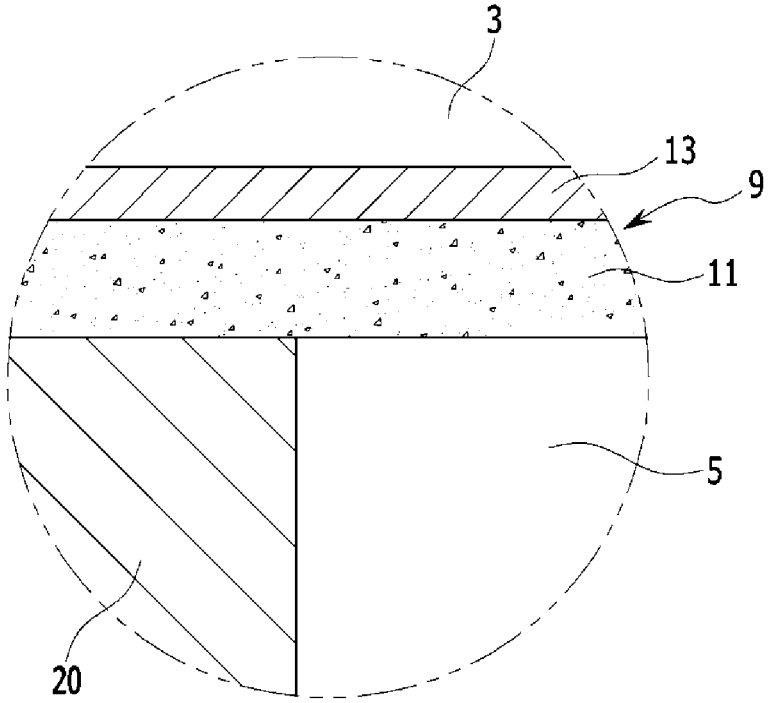
FIG. 3 is an enlarged view of part A of FIG. 2 according to an exemplary embodiment of the present invention.

FIG. 1 is a view illustrating the waste gate valve according to the exemplary embodiment of the present invention, FIG. 2 is a partial enlarged view of the waste gate valve according to an exemplary embodiment of the present invention, and FIG. 3 is an enlarged view of part A of FIG. 2 according to an exemplary embodiment of the present invention.

Referring to FIGS. 1 to 3, the waste gate valve 1 according to an exemplary embodiment of the present invention includes a valve body 3 which is installed on a turbocharger body 20, and the valve body 3 selectively opens and closes a waste gate 5 formed in the turbocharger body 20.

When pressure of exhaust gas, which flows into the turbocharger, reaches a predetermined level or more, the valve body 3, which has closed the waste gate 5, is opened, such that a part of the exhaust gas is discharged while bypassing the turbocharger.

A valve seat 7 is formed on the turbocharger housing 20, and a layer 9 is formed between the valve seat 7 and the valve body 3 that comes into contact with the valve seat 7.

Further, the layer 9 includes a ceramic layer 11, and an insert material 13.

The ceramic layer 11 has a characteristic that is strong against a high temperature and deformation, and is joined to the valve body 3 through the insert material 13 by brazing.

The ceramic layer 11 is exposed to a high temperature, and has durability against thermal deformation and abrasion of the valve body 3 that comes into contact with the valve seat 7.

The ceramic layer 11 may be formed on only a surface of the valve body 3 which is directly and thermally deformed and abraded while coming into contact with the valve seat 7. Therefore, an increase in manufacturing costs may be suppressed by locally and restrictively applying a comparatively expensive ceramic material.

The insert material 13 is made of a material that has a lower melting point than a material of the valve body 3, and is interposed between the valve body 3 and the ceramic layer 11.

The insert material 13 may have a base made of nickel (Ni), and a material layer which is disposed outside the nickel (Ni) and includes chromium (Cr: 7.0%), boron (B: 3.2%), silicon (Si: 4.5%), and iron (Fe: 3.0%) which are mixed.

The ceramic layer 11 and the valve body 3 may be joined through brazing.

The brazing is performed in a high-temperature vacuum furnace in order to prevent contamination of a joint portion, and in this case, a temperature in the vacuum furnace may be lower than a melting point of the valve body 3 that is a base material, and may be higher than a melting point of the insert material 13.

Accordingly, when the brazing is performed, the valve body 3, which is a base material, is prevented from being thermally deformed by a temperature in the vacuum furnace, and the insert material 13, which has a lower melting point than the valve body 3, is melted to join the ceramic layer 11 to the valve body 3.

In the waste gate valve 1 according to an exemplary embodiment of the present invention, which has the aforementioned configuration, the ceramic layer, which is strong against a high temperature and deformation, is joined to a surface of the valve body 3 which comes into contact with valve seat 7, thereby improving durability of the waste gate valve 1 against deformation and abrasion due to a high temperature.

Accordingly, deterioration in performance of the turbocharger and deterioration in function of the waste gate valve 1 may be prevented.

In addition, when the ceramic layer 11 is joined to the valve body 3 by brazing, the insert material 13, which has a lower melting point than a material of the valve body 3, is interposed between the valve body 3 and the ceramic layer 11, thereby ensuring joinability between the valve body 3 and the ceramic layer 11.

In addition, in the exemplary embodiment of the present invention, when an opening and closing operation of the valve body 3 is performed, operational noise, which is generated between the valve body 3 and the valve seat 7, may be reduced by the ceramic layer 11 and the insert material 13.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A waste gate valve which is installed on a turbocharger to selectively discharge a part of exhaust gas while allowing the part of the exhaust gas to bypass the turbocharger, the waste gate valve comprising:

a layer which is formed between a valve seat and a valve body that comes into contact with the valve seat, wherein the layer is formed on a surface of the valve body which faces the valve seat of the waste gate valve, wherein the layer includes:

a ceramic layer which comes into contact with the valve seat; and an insert material which is interposed between the valve body and the ceramic layer, wherein the insert material is made of a material that has a lower melting point than the valve body, and wherein the insert material includes nickel (Ni), chromium (Cr), boron (B), silicon (Si), and iron (Fe).

2. The waste gate valve of claim 1, wherein the layer is formed by joining the ceramic layer to the valve body using the insert material by brazing.

3. The waste gate valve of claim 2, wherein the joining is performed as brazing.

4. The waste gate valve of claim 3, wherein the brazing is performed in a high-temperature vacuum state.

5. The waste gate valve of claim 4, wherein the brazing is performed in a high-temperature vacuum furnace, and a temperature in the vacuum furnace is lower than a melting point of the valve body, and higher than a melting point of the insert material.

* * * * *